US005545125A

United States Patent [19]

Tseng

[11] Patent Number: 5,545,125

[45] Date of Patent: Aug. 13, 1996

[54] AUTO CYCLING MULTI-FUNCTIONAL MASSAGING DEVICE

[76] Inventor: Chin C. Tseng, No. 13, Lane 380, Sec. 2, Chung-Shan Rd., Chung-Ho City, Taipei, Taiwan

[21] Appl. No.: 411,511

[22] Filed: Mar. 28, 1995

[51] Int. Cl.[6] ..... A61H 1/00

[52] U.S. Cl. ..... 601/71; 601/70

[58] Field of Search ..... 601/46, 70, 71, 601/72, 73, 74, 78, 79

[56] References Cited

U.S. PATENT DOCUMENTS

| | | | |
|---|---|---|---|
| 4,055,169 | 10/1977 | Baker | 601/46 |
| 4,559,929 | 12/1985 | Hseu | 601/70 |
| 4,732,140 | 3/1988 | Stoffregen | 601/71 |
| 5,140,976 | 8/1992 | Cheng | 601/70 |
| 5,181,504 | 1/1993 | Ono | 601/71 |
| 5,188,096 | 2/1993 | Yoo | 601/57 |
| 5,334,131 | 8/1994 | Omandam | 601/70 |

*Primary Examiner*—Robert A. Hafer
*Assistant Examiner*—David Kenealy
*Attorney, Agent, or Firm*—Bacon & Thomas

[57] ABSTRACT

An auto cycling multi-functional massaging device having two to sixteen motor assemblies each of which is provided with an eccentric wheel and is retained in a housing, each of the housings is placed respectively in a space in a belt-shaped soft pad, and secured by a cover and a belt. The back of the belt-shaped soft pad is attached to a piece of sponge tape, the belt and the tape being sewn together. The ends of the belt-shaped soft pad are respectively provided with latching band for attachment to the waist. the motors are controlled by a control box, having a circuit board for controlling the time and the cycling vibration of the motors, and for controlling whether the motors are operated individually or all at the same time. The operating mode of the device can be changed by pressing switches on the control box.

3 Claims, 6 Drawing Sheets

AUTO CYCLING MULTI-FUNCTIONAL MASSAGING DEVICE

BACKGROUND OF THE INVENTION (a) Field of the Invention

The present invention relates to an auto-cycling, multi-functional massaging device, particularly a waistband-type massaging device with multiple sections and variable speed control.

(b) Description of the Prior Art

We are living in a society that is constantly changing, and the concept of "Time is Money" is built into our society. More and more people are always busy with their work and have no time for exercising. Sitting in the office for a long time makes their waist sizes grow larger and larger. In order to maintain their health, some people use belt-type vibrators to massage the body for increasing blood flow and promote health. However, these types of vibrators are usually secured and mounted on a machine and they are not portable to be carried around for use. They are relatively inconvenient and their massaging effects are very low.

There are a lot of massaging devices available nowadays, but most of these devices use a single motor to generate the vibration. Their effects are simple and most people do not enjoy using them. These devices cannot provide the effects that they are designed for. The inventor, after in-depth research in this area, has come up with a new design of a massaging device which provides multi sectional control, variable speed and automatic cycling of the vibrator.

SUMMARY OF THE INVENTION

The main object according to the present invention is to provide an auto cycling, multi-functional massaging device comprising 2 to 16 motor assemblies each of which is provided with an eccentric wheel and is retained in a housing. Each of the housings is respectively placed in a space of a belt-shaped soft pad and are secured by a cover and the belt. The back of the belt-shaped soft pad is attached to a piece of sponge tape and they are sewn together. Both ends of the belt-shaped soft pad are respectively provided with latching bands, thereby the belt can be wrapped around the waist of a user. The motors are controlled by a control box, having a circuit board provided with a special chip for controlling the time and the cycling vibration of the motors, and for controlling the motors so as to be operated individually or all at the same time. The vibration from the motors generates rubbing effects which increase the circulation of blood flow and may promote the health of the user.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
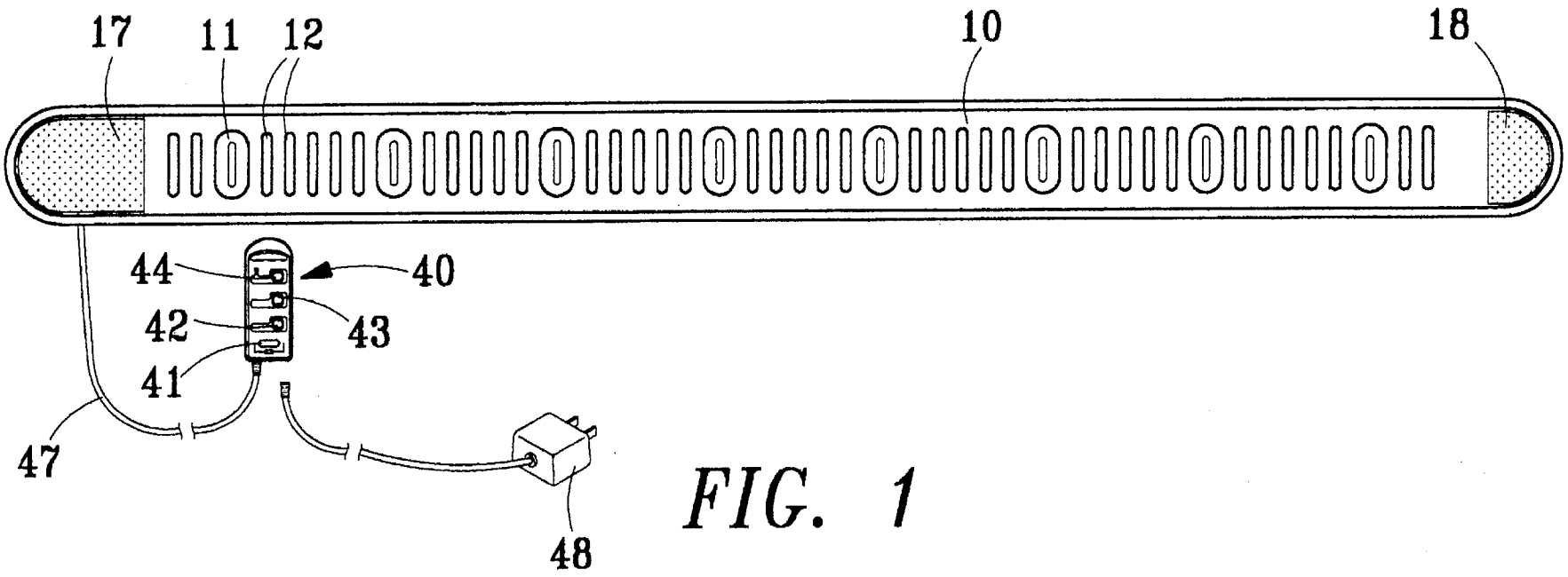
FIG. 1 is a diagrammatic view showing an embodiment of the unfolded waistband according to the present invention.
Figure 2:
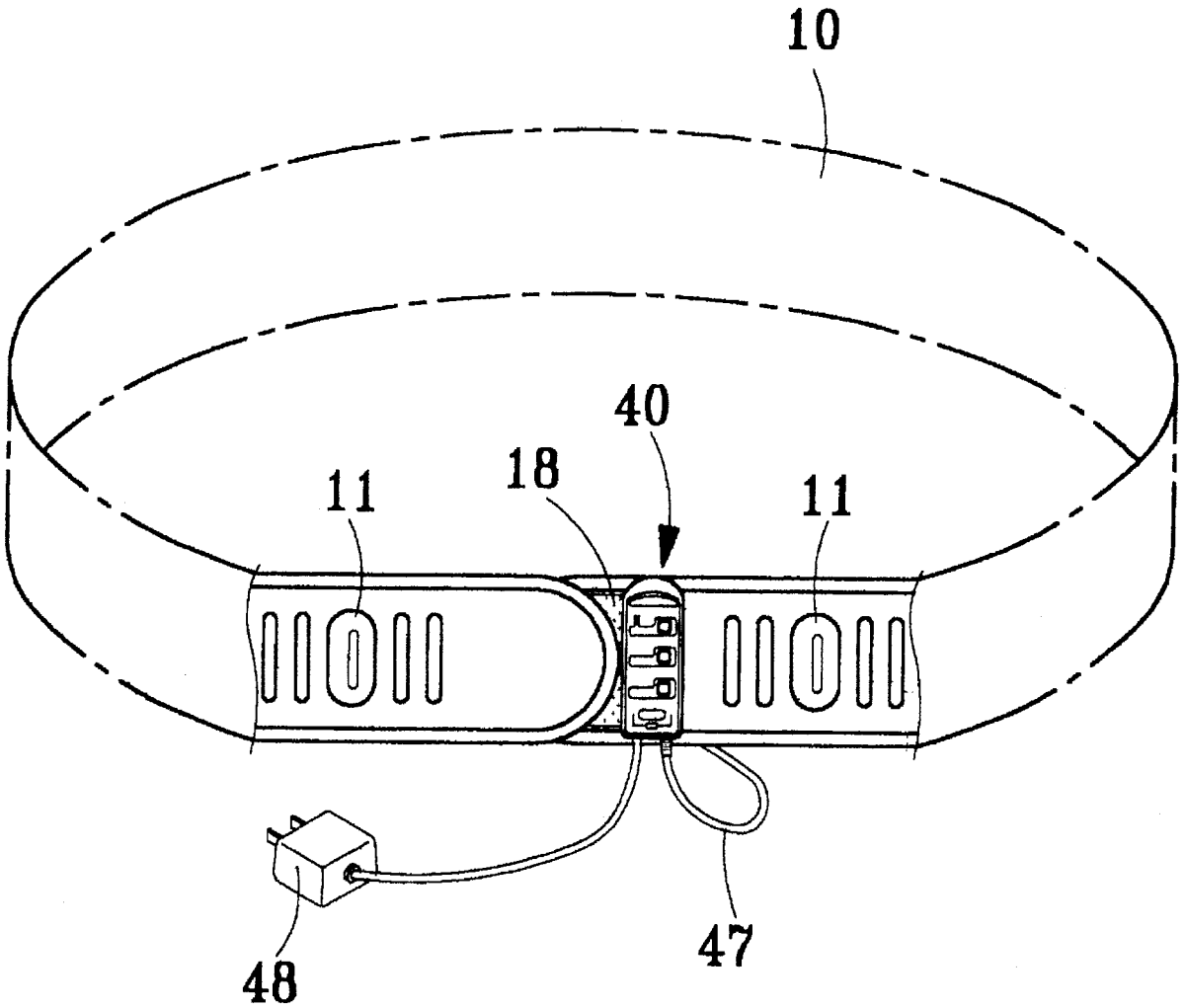
FIG. 2 is a diagrammatic view illustrating the use of the waistband according to the present invention.

Please refer to FIGS. 1 through 5, wherein the auto cycling multi-functional massaging device according to the present invention is shown in an embodiment of a waistband. As shown in FIG. 1, the belt-shaped soft pad 10 has 4 to 8 spaces 11 opening outward, and several protruding strips 12 provided in between the adjacent spaces 11. FIG. 1 shows that there are five strips between adjacent spaces 11. The number of the spaces 11 may also be reduced to two or increased up to sixteen. Simply speaking, the number of the spaces depends on the waist size of the individual, and it may encompass any appropriate number. The waistband is shown unfurled in FIG. 1; it may be looped around the waist, as is shown in FIG. 2; or the waistband may also be looped around other appropriate parts, such as the back, the shoulder, the neck, the arm and the thigh of the body. Each of the spaces 11 is provided with a housing 20 retained therein.

Figure 3:
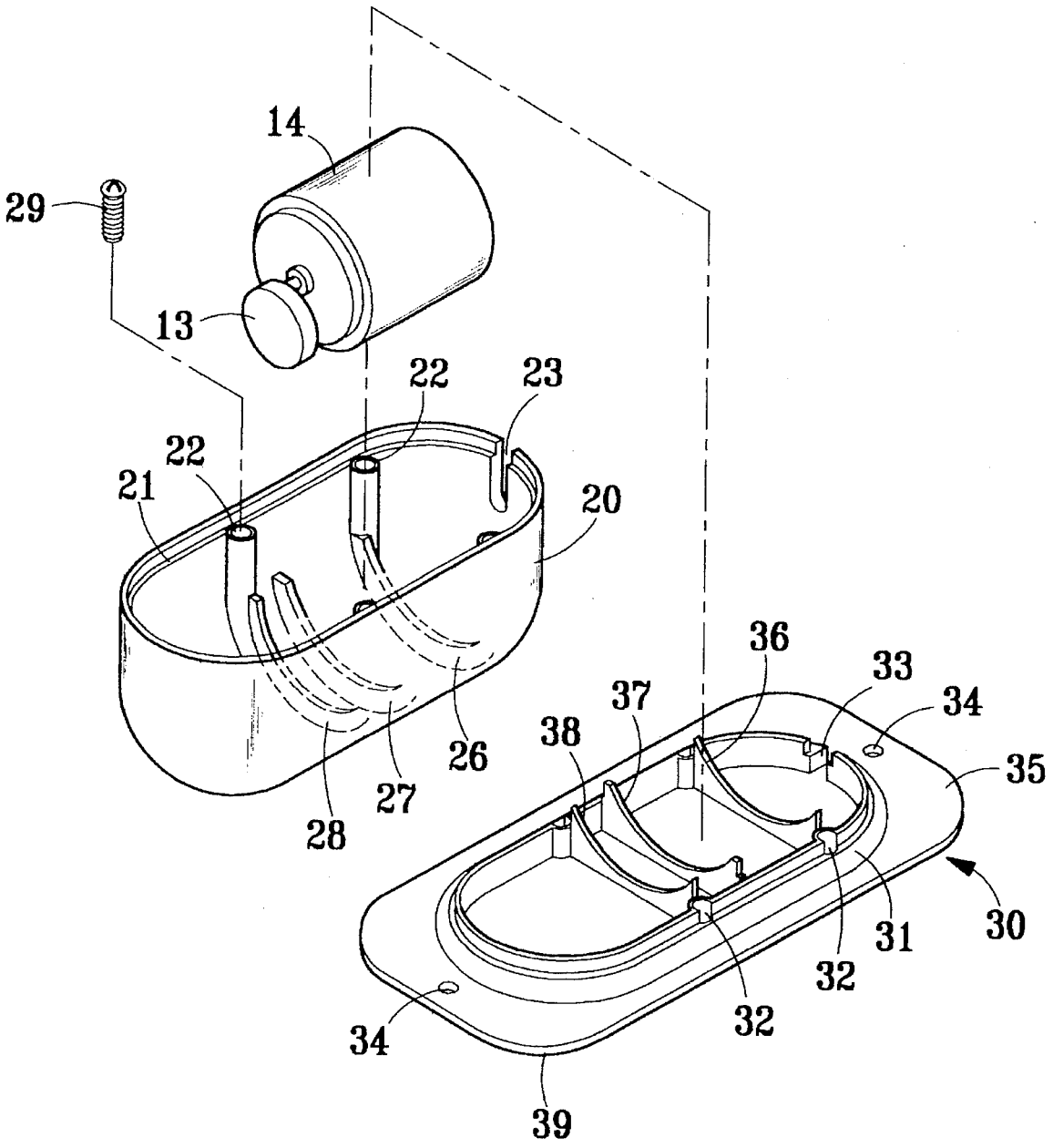
FIG. 3 is an exploded perspective view showing the motor, the motor housing and the cover of the present invention.
Figure 3A:
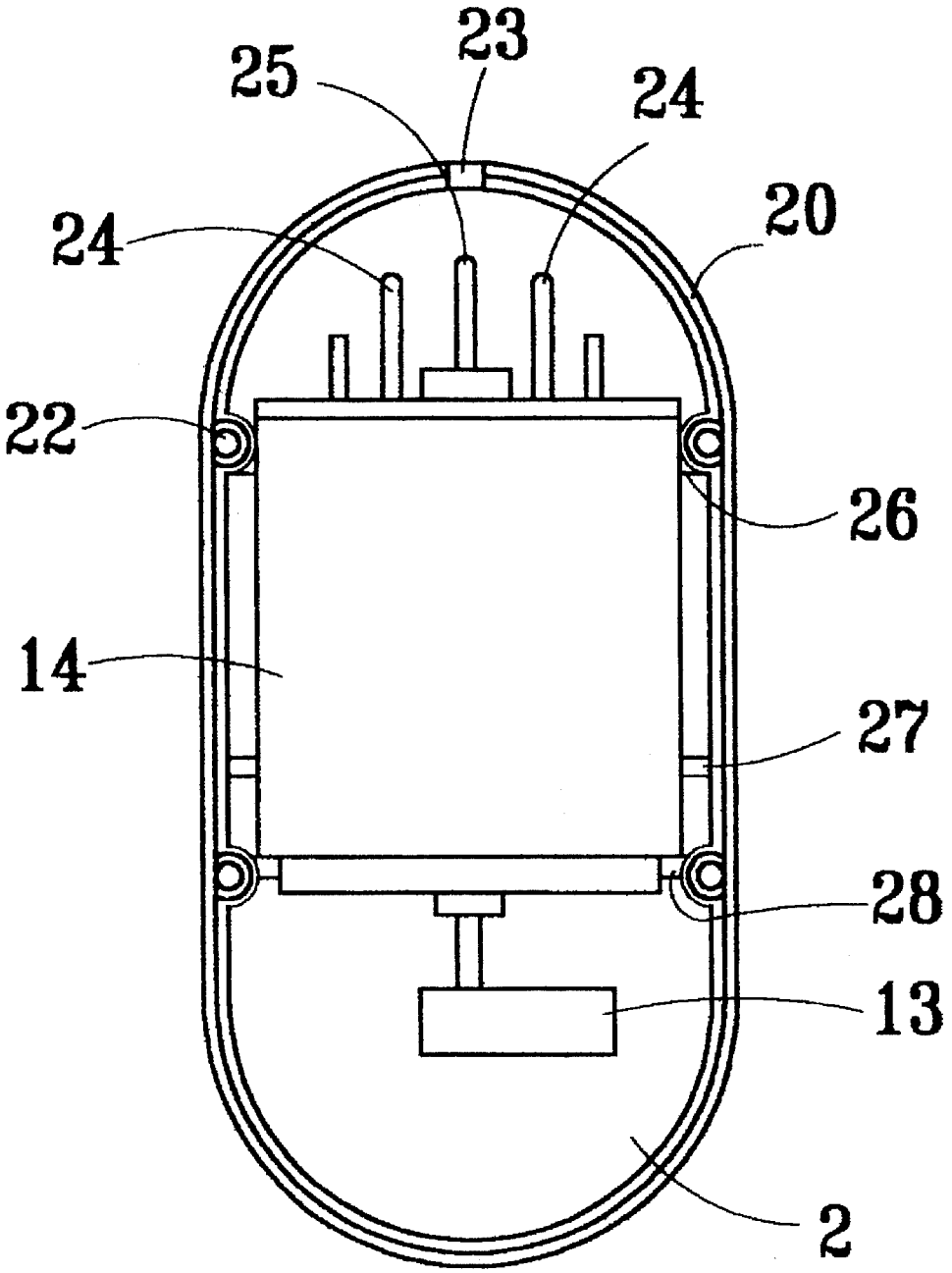
FIG. 3A is a cutaway top view of the present invention.

As shown in FIG. 3, the top of the housing 20 is provided with an elliptical opening 21, the two sides of the housing 20 are each provided with a pair of screw posts 22, the forward portion is provided with a slot 23 for running electrical wires. Referring to FIG. 3A, the bottom surface of the housing 20 (close to slot 23) is provided with a center post 25 and two side posts 24, all of which posts have an elliptical arc-shaped surface. In addition, the arc-shaped bottom surfaces of the screw posts 22 are respectively provided with front and rear protruded semi-circular rings 26 and 28. In addition, an intermediate protruded ring 27 is provided in the proximity of the arc-shaped bottom surface of the protruded ring 28. A flat cover 30 is provided corresponding to the housing 20, wherein the flat cover 30 has an extended portion 35 extending beyond the boundaries of housing 20. The four corners of the extended portion 35 are substantially round and each of the corners has a circular-arc-shaped portion 39. The bottom surface of the cover 30 (corresponding to the opening 21 of the egg-shaped housing 20) is provided with an elliptical protruding member 31, which is used to tightly seal the opening 21. The inner side of the protruding member 31 (corresponding to the screw posts 22) is provided with screw holes 32, and in between the screw holes 32 are provided with front and rear protruding plates 36 and 38. An intermediate protruding plate 37 is provided close to the rear protruding plate 38. The top of each of the protruding plates is a concave arc surface. The front portion of the cover 30 is provided with a hole 33 for feeding through the electrical wiring. The shaft of motor 14 has an eccentric wheel 13 retained at the center post 25, and the rear side surfaces of the two side posts 24 are used to support the surface of the motor 14. An end of the motor 14 has a recessed portion that is retained by the rear protruded ring 28 of the housing 20 and the rear protruded plate 38 of the cover 30. In addition, the surface of the motor 14 is secured in place by the front protruded ring 26, the intermediate protruded ring 27, the front protruding plate 36 and the intermediate protruding plate 37, allowing the eccentric wheel 13 to be rotated by motor 14 into vibration within the space 2 in the housing 20. The cover 30 is secured to the housing 20 by four screws 29 through the screw holes 32 and the screw posts 22. The wiring of the motor 14 is connected, through the slot 23 and the hole 33, to the main wiring 47. by such configuration, a unique motor assembly 1 is formed.

Figure 4:
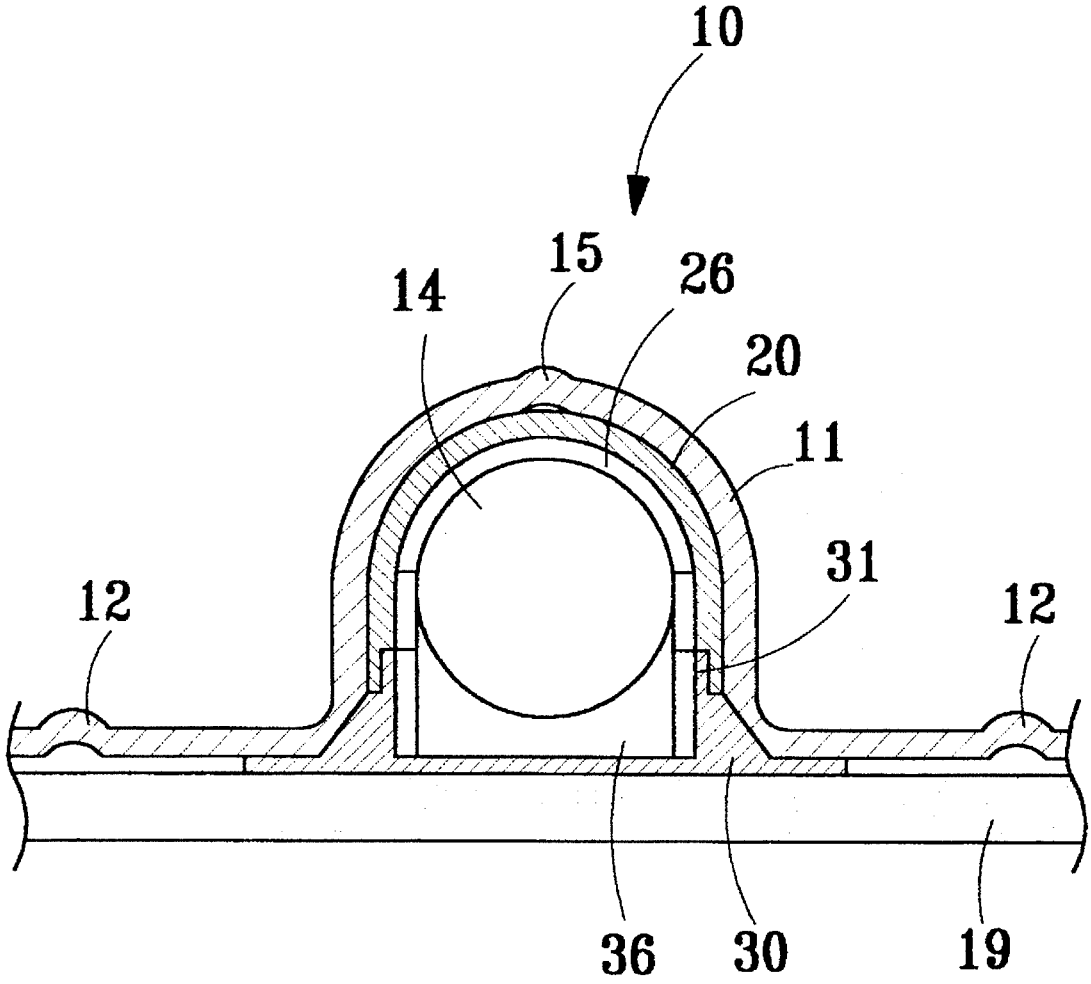
FIG. 4 is a cross-sectional view of the motor and housing assembly according to the present invention.

As shown in FIG. 4, each motor assembly 1 within the housing 20 is placed inside the space 11 of the belt-shaped soft pad 10, and the top of each of the space 11 is provided with a small protruded member 15. The forward and rearward portion of the extended portion 35 of the cover 30 are respectively provided with a hole 34. By use of the hole 34 and bolts and nuts, the motor assembly can be secured together with the belt-shaped soft pad 10. the back of the belt 10 is attached to a piece of sponge tape 19 which has the same size as the belt 10. The belt-shaped soft pad 10 and the piece of sponge tape are sewn together to form a waistband with latching band at each end. The forming of the latching band is accomplished by having a male latching band 17 on the sponge tape 19 and a female latching band 19 attached to the belt 10. Thus, with the use of the latching bands 17 and 18, the belt 10 can be formed into a waistband for attaching to the waist or other portion of the body, as is shown in FIG. 2. The length of the latching bands can be adjusted for fitting different waist sizes.

Figure 5:
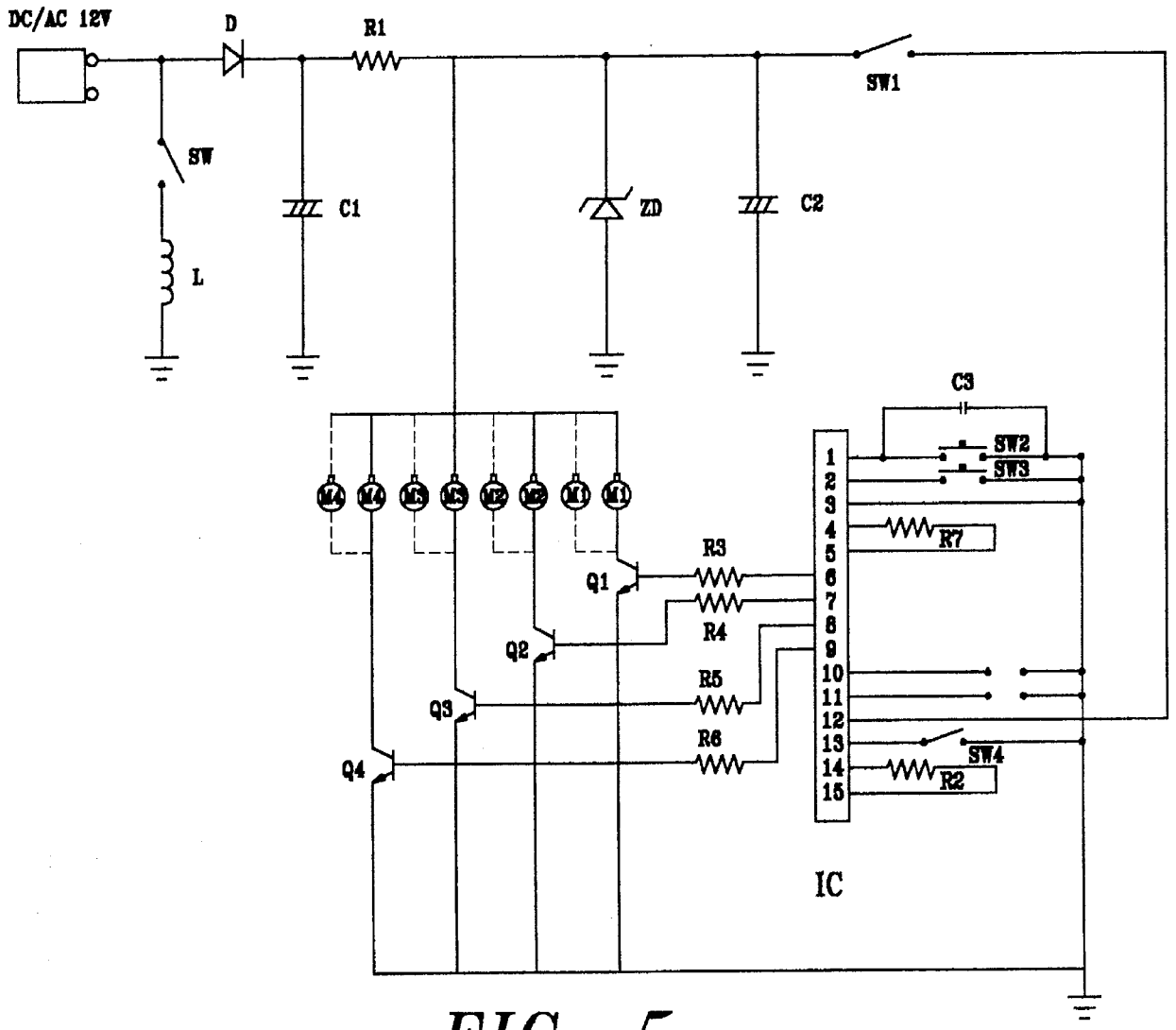
FIG. 5 is a circuit diagram of the present invention.

The wiring of the motor assemblies 1 are tied together through a main wire 47 to the circuit board of a control box 40. The circuitry with special chips and switches is shown in FIG. 5. The present invention can either accept either 12 VAC or 12 VDC voltage. The 12 VAC comes from a plug 48, which receives its voltage from a transformer converting 110V or 220V into a secondary 12 VAC voltage. An automobile cigarette lighter plug is also provided with the invention for 12 VDC supply. A rectifying diode D, a resistor R1, a capacitor C1 and a zener diode ZD are disposed between the power supply and power switch SW1 for providing a stable voltage to feed into a specially made integrated circuit (IC). Integrated Circuit (IC) has four outlets each connects respectively with resistor R3, R4, R5 and R6 so as to provide the proper voltage for transistor Q1, Q2, Q3 and Q4 to power the four (or eight) motors M1, M2, M3 and M4. The dotted lines indicate the connection of the motors added to the existing design, the total number of motors connected can be up to 16. In addition, the integrated circuit is also connected to a function switch SW2 (for selecting required function), a time switch SW3 (for setting motor rotation time period and interval), and motor switch SW4 (for controlling the operation of any motor). All of power switch SW1, function switch SW2, time switch SW3 and motor switch SW4 are disposed on control box 40 (as shown respectively by 41, 42, 43 and 44 in FIG. 1) for the user's easy access and use. When the power is turned on, motors M1, M2, M3 and M4 operate in sequence and the operation recycle. When function switch 42 is pressed once, the motors M4+ M1, M1+ M2, M2+ M3 and M3+ M4 rotate in clockwise direction for pre-set cycles (e.g. ten cycles), then the motors automatically rotate in counter-clockwise direction for another pre-set cycle before returning to rotate in the clockwise direction. The time switch 43 can be used to control the rotation time period and interval of the motor. Each time the time switch 43 is pressed, the rotation time period of the motor will be increased. A total of four different time periods can be set by time switch 43. Pressing the function switch 42 twice, all of the motors start at the same time and the cycle feature is disabled; by pressing the motor control switch 44, only one of the motors will operate. Thus, the vibration generated from the motor can be used to massage the muscle or body that requires treatment. Batteries can be connected in series for powering the present invention. The back of the control box 40 is also provided with latching bands for attaching to the waist of the body. Thus, a user can carry the massaging device anywhere and have it ready for massaging wherever he needs it, a unique feature of the present invention.

In summary, the present invention provides a new design of a waistband massaging device which has multiple section, automatic cycling features. The massaging effect is special and the feeling is unique.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An auto cycling multi-functional massaging device comprising: a belt-shaped soft pad having opposite ends, a plurality of spaced apart protrusions opening outward on one side and a plurality of protruding strips between adjacent spaced apart protrusions; a plurality of motor assemblies, each including a motor driven eccentric wheel to produce a vibration when rotated, a motor assembly attached to the belt shaped soft pad in each spaced apart protrusion; a sponge tape having the same size as the belt-shaped soft pad attached to the belt shaped soft pad on a side opposite of the plurality of spaced apart protrusions; a latching band at each opposite end of the belt shaped pad thereby enabling the belt-shaped soft pad to be attached to the body of a user and function as a massager; an electrical circuit means connecting each of the plurality of motor assemblies to a circuit board of a control box having an integrated circuit and a plurality of control switches for controlling the operation of all the motors whereby the motors may be actuated in a predetermined sequence or simultaneously and whereby the time of operation of the motors may be controlled by the user.

2. The auto cycling multi-functional massaging device of claim 1 wherein each said motor assembly comprises: a housing; a motor and eccentric wheel in the housing; a cover attached to the housing so as to enclose the motor and eccentric wheel; an elliptical opening formed in a top of the housing; a pair of screw posts on, two opposite sides of the housing having a center post and two side posts, each having elliptical arc-shaped surfaces, front and rear protruding semi-circular rings, and an intermediate protruding ring; the cover having an extended portion extending beyond a periphery of the housing, with four corners of the extended portion having a substantially circular-arc-shaped portion, a bottom surface of the cover is provided with an elliptical protruding member having screw holes on an inner side of the protruding member aligned with the screw posts front and rear protruded plates extending between the screw holes, a top of each of the protruded plates formed as a concave are surface, a front portion of the cover is provided with a hole for feeding the electrical wiring through, whereby the motor is retained at the center post, and the rear side surfaces of the two side posts an end of the motor is retained by the rear protruded ring of the body and the rear protruded plate of the cover, the motor being secured in place by the front protruded ring, the intermediate protruded ring, the front protruded plate and the intermediate protruded plate, and the cover is secured to the housing by screws passing through the screw holes and the screw posts.

3. The auto cycling multi-functional massaging device of claim 1 wherein the electrical circuit means comprises a rectifying diode, a resistor, a capacitor and a zener diode connected between a power supply and a power switch for providing a stable voltage to the circuit board, the motors being connected to the integrated circuit through a plurality of resisters and a transistor, such that the motors are connected in parallel with each other, the integrated circuit providing a function selection, a time period selection and a motor selection, the control box being connected with the integrated circuit having a power switch to turn on the power supply, a function switch for selecting one of a plurality of predetermined functions, a time switch for selecting different operating time periods of the motors and a motor switch for selecting different motors to operate, whereby the electrical circuit comprises means to control the operation of the device such that, when power is turned on, each of the motors operate in a predetermined sequence and the operation recycles, when the function switch is pressed once, the motors operate sequentially in pairs in a clockwise direction for predetermined cycles for a predetermined period of time, after which the motors automatically rotate in a counter-clockwise direction for another predetermined cycle for a predetermined period of time before returning to rotate in the clockwise direction; by pressing on the function switch twice, all of the motors start at the same time and the cycle feature is disabled; by pressing on the motor switch, only one of the motors will operate; pressing on the time switch for an incremental time, the motor operation time period will be increased gradually.

* * * * *